US008703679B2

(12) United States Patent
Li et al.

(10) Patent No.: US 8,703,679 B2
(45) Date of Patent: Apr. 22, 2014

(54) GLYCEROL-CONTAINING FUNCTIONAL FLUID

(76) Inventors: Yue-Rong Li, Albany, CA (US); Frank Plavac, Mill Valley, CA (US); Rawls Frazier, Petaluma, CA (US)

( * ) Notice: Subject to any disclaimer, the term of this patent is extended or adjusted under 35 U.S.C. 154(b) by 0 days.

(21) Appl. No.: 13/297,030

(22) Filed: Nov. 15, 2011

(65) Prior Publication Data

US 2013/0123155 A1 May 16, 2013

(51) Int. Cl.
*C10M 129/76* (2006.01)
*C10M 137/10* (2006.01)
*C10M 159/24* (2006.01)

(52) U.S. Cl.
USPC ..... 508/501; 508/369; 508/391

(58) Field of Classification Search
USPC ..... 508/186, 369, 501, 391
See application file for complete search history.

(56) References Cited

U.S. PATENT DOCUMENTS

| | | | | |
|---|---|---|---|---|
| 2,871,191 | A * | 1/1959 | Schott | 508/462 |
| 4,803,002 | A | 2/1989 | Wollenberg | |
| 6,495,703 | B1 * | 12/2002 | Okutsu et al. | 549/229 |
| 2007/0142237 | A1 * | 6/2007 | DeGonia et al. | 508/187 |
| 2008/0110083 | A1 | 5/2008 | Baehr et al. | |
| 2008/0176777 | A1 * | 7/2008 | Milner et al. | 508/382 |

FOREIGN PATENT DOCUMENTS

| | | | |
|---|---|---|---|
| EP | 1156042 | A1 | 11/2001 |
| EP | 1422286 | A1 | 5/2004 |

* cited by examiner

*Primary Examiner* — Prem Singh
*Assistant Examiner* — Vishal Vasisth
(74) *Attorney, Agent, or Firm* — Carlton Virassammy; Claude J. Caroli

(57) ABSTRACT

A functional fluid comprising a major amount of an oil of lubricating viscosity, and an oil soluble amount of glycerol carbonate or an oil soluble amount of a borated glycerol.

11 Claims, No Drawings

GLYCEROL-CONTAINING FUNCTIONAL FLUID

FIELD OF INVENTION

The present invention relates to functional fluids useful in systems requiring power transmission fluids, hydraulic fluids and/or lubrication of moving parts. In particular, the present invention relates to a functional fluid containing an organic wear inhibitor for use in tractor hydraulic fluids.

BACKGROUND OF THE INVENTION

Modern lubricating oil formulations are formulated to exacting specifications often set by original equipment manufacturers. To meet such specifications, various additives are used, together with base oil of lubricating viscosity. Depending on the application, a typical lubricating oil composition may contain dispersants, detergents, anti-oxidants, wear inhibitors, rust inhibitors, corrosion inhibitors, foam inhibitors, and friction modifiers just to name a few. Different applications will govern the type of additives that will go into a lubricating oil composition.

A functional fluid is a term which encompasses a variety of fluids including but not limited to tractor hydraulic fluids, power transmission fluids including automatic transmission fluids, continuously variable transmission fluids and manual transmission fluids, hydraulic fluids, including tractor hydraulic fluids, gear oils, power steering fluids, fluids used in wind turbines and fluids related to power train components. It should be noted that within each of these fluids such as, for example, automatic transmission fluids, there are a variety of different types of fluids due to the various transmissions having different designs which have led to the need for fluids of markedly different functional characteristics.

With respect to tractor hydraulic fluids, these fluids are all-purpose products used for all lubricant applications in a tractor except for lubricating the engine. Also included as a tractor hydraulic fluid for the purposes of this invention are so-called Super Tractor Oil Universal fluids or "STOU" fluids, which also lubricate the engine. These lubricating applications may include lubrication of gearboxes, power take-off and clutch(es), rear axles, reduction gears, wet brakes, and hydraulic accessories. The components included within a tractor fluid must be carefully chosen so that the final resulting fluid composition will provide all the necessary characteristics required in the different applications. Such characteristics may include the ability to provide proper frictional properties for preventing wet brake chatter of oil immersed brakes while simultaneously providing the ability to actuate wet brakes and provide power take-off (PTO) clutch performance. A tractor fluid must provide sufficient antiwear and extreme pressure properties as well as water tolerance/filterability capabilities. The extreme pressure (EP) properties of tractor fluids, important in gearing applications, may be demonstrated by the ability of the fluid to pass a spiral bevel test as well as a straight spur gear test. The tractor fluid may need to pass wet brake chatter tests while providing adequate wet brake capacity when used in oil immersed disk brakes which are comprised of a bronze, graphitic-compositions and asbestos. The tractor fluid may need to demonstrate its ability to provide friction retention for power shift transmission clutches such as those clutches which include graphitic and bronze clutches.

When the functional fluid is an automatic transmission fluid, the automatic transmission fluids must have enough friction for the clutch plates to transfer power. However, the friction coefficient of fluids has a tendency to decline due to the temperature effects as the fluid heats up during operation. It is important that the tractor hydraulic fluid or automatic transmission fluid maintain its high friction coefficient at elevated temperatures, otherwise brake systems or automatic transmissions may fail.

A need exists for an alternative organic anti-wear agent for use in tractor hydraulic fluids that maintains the protection of gears at slow speeds.

JP05-105895 teaches lubricating oil compositions for wet clutches and brakes used in power transmission units in among other uses in agricultural, construction, and other industrial machinery, containing 0.01-10 parts by weight of a $C_2$-$C_{14}$ aliphatic compound having two or more hydroxyl groups per 100 parts by weight of a base oil. In particular JP05-105895 teaches such oils are especially useful as transmission fluids. Glycerol is disclosed as such a $C_2$-$C_{14}$ aliphatic compound having two or more hydroxyl groups but is not exemplified.

Bayles, Jr. et al., U.S. Pat. No. 5,284,591, is directed to a multipurpose functional fluid which is comprised of a major amount of a hydrocarbon oil and a minor amount, sufficient to improve characteristics of the fluid of a novel additive. The additive is comprised of a calcium salt complex, a group II metal dithiophosphate salt, a borated epoxide, a carboxylic solubilizer and a sulfurized composition.

Stoffa et al., U.S. Pat. No. 5,635,459 is directed to a function fluid composition having improved gear performance which comprises an oil of lubricating viscosity, and added thereto (a) an alkali or alkaline earth metal salt complex in the form of borated and/or non-borated salts; (b) an EP/antiwear agent comprising a mixture of zinc salts of dialkylphosphorodithioic acid and 2-ethylhexanoic acid heated with triphenyl phosphite or an olefin; and (c) a borated epoxide.

SUMMARY OF THE INVENTION

In one embodiment, the present invention is directed to a functional fluid comprising (a) a major amount of an oil of lubricating viscosity and (b) an oil soluble amount of glycerol carbonate or an oil soluble amount of a borated glycerol.

In one embodiment, the present invention is also directed to a functional fluid comprising a major amount of an oil of lubricating viscosity; more than about 0.1 wt % of glycerol carbonate; at least about up to 5.0 wt % of at least one low overbased sulfonate detergent; at least about up to 5.0 wt % of at least one high overbased sulfonate detergent; and at least one antiwear additive.

In one embodiment, the present invention is directed to a functional fluid comprising a major amount of an oil of lubricating viscosity; more than 0.1 wt % of borated glycerol and less than or equal to about 0.5 wt % borated glycerol; at least about up to 5.0 wt % of at least one low overbased sulfonate detergent; at least about up to 5.0 wt % of at least one high overbased sulfonate detergent; and at least one antiwear additive.

In one embodiment, the present invention is directed to an additive concentrate comprises an oil soluble amount of a) borated glycerol or (b) glycerol carbonate in a diluent oil wherein the additive concentrate contains from about 1% to about 99% by weight of said diluent.

In one embodiment, the present invention is directed to a method of reducing friction comprising contacting a metal surface with a functional fluid comprising a major amount of an oil of lubricating viscosity and an oil soluble amount of (i) glycerol carbonate or an oil soluble amount of (ii) borated glycerol.

DETAILED DESCRIPTION OF THE INVENTION

Prior to discussing the present invention in detail, the following terms will have the following meanings unless expressly stated to the contrary.

Definitions

The term "alkaline earth metal" refers to calcium, barium, magnesium, strontium, or mixtures thereof.

The term "alkyl" refers to both straight- and branched-chain alkyl groups.

The term "metal" refers to alkali metals, alkaline earth metals, transition metals or mixtures thereof.

The term "Metal to Substrate ratio" refers to the ratio of the total equivalents of the metal to the equivalents of the substrate. An overbased sulphonate detergent typically has a metal ratio of 12.5:1 to 40:1, in one aspect 13.5:1 to 40:1, in another aspect 14.5:1 to 40:1, in yet another aspect 15.5:1 to 40:1 and in yet another aspect 16.5:1 to 40:1.

TBN numbers reflect more alkaline products and therefore a greater alkalinity reserve. The TBN of a sample can be determined by ASTM Test No. D2896 or any other equivalent procedure. In general terms, TBN is the neutralization capacity of one gram of the lubricating composition expressed as a number equal to the mg of potassium hydroxide providing the equivalent neutralization. Thus, a TBN of 10 means that one gram of the composition has a neutralization capacity equal to 10 mg of potassium hydroxide. TBN of the actives should be measured.

The term "low overbased" or "LOB" refers to an overbased detergent having a low TBN of the actives of about 0 to about 60.

The term "medium overbased" or "MOB" refers to an overbased detergent having a medium TBN of the actives of greater than about 60 to about 200.

The term "high overbased" or "HOB" refers to an overbased detergent having a high TBN of the actives of greater than about 200 to about 400.

As stated above, the present invention provides a method of improving the brake and clutch capacity of a functional fluid by adding a wear inhibitor of either borated glycerol or glycerol carbonate to the functional fluid.

Functional Fluids

The functional fluids of the present invention use base oils derived from mineral oils, synthetic oils or vegetable oils. The base oil of lubricating viscosity for use in the lubricating oil compositions of this invention is typically present in a major amount, e.g., an amount of 50 weight percent or greater, preferably greater than about 70 weight percent, more preferably from about 80 to about 99.5 weight percent and most preferably from about 85 to about 98 weight percent, based on the total weight of the composition. The expression "base oil" as used herein shall be understood to mean a base stock or blend of base stocks which is a lubricant component that is produced by a single manufacturer to the same specifications (independent of feed source or manufacturers location); that meets the same manufacturers specification; and that is identified by a unique formula, product identification number, or both. The base oil for use herein can be any of those well known in the art as base oils used in formulating lubricating oil compositions for any and all such applications, e.g., engine oils, marine cylinder oils, functional fluids such as hydraulic oils, gear oils, transmission fluids, etc., provided that the oil of lubricating viscosity does not contain a carboxylic acid ester.

As one skilled in the art would readily appreciate, the viscosity of the base oil is dependent upon the application. Accordingly, the viscosity of a base oil for use herein will ordinarily range from about 2 to about 2000 centistokes (cSt) at 100° Centigrade (C.). Generally, individually the base oils used as engine oils will have a kinematic viscosity range at 100° C. of about 2 cSt to about 30 cSt, preferably about 3 cSt to about 16 cSt, and most preferably about 4 cSt to about 12 cSt and will be selected or blended depending on the desired end use and the additives in the finished oil to give the desired grade of engine oil, e.g., a lubricating oil composition having an SAE Viscosity Grade of 0W, 0W-20, 0W-30, 0W-40, 0W-50, 0W-60, 5W, 5W-20, 5W-30, 5W-40, 5W-50, 5W-60, 10W, 10W-20, 10W-30, 10W-40, 10W-50, 15W, 15W-20, 15W-30 or 15W-40. Oils used as gear oils can have viscosities ranging from about 2 cSt to about 2000 cSt at 100° C.

Base stocks may be manufactured using a variety of different processes including, but not limited to, distillation, solvent refining, hydrogen processing, oligomerization, and rerefining. Rerefined stock shall be substantially free from materials introduced through manufacturing, contamination, or previous use. The base oil of the lubricating oil compositions of this invention may be any natural or synthetic lubricating base oil provided that the oil of lubricating viscosity does not contain a carboxylic acid ester. Suitable hydrocarbon synthetic oils include, but are not limited to, oils prepared from the polymerization of ethylene or from the polymerization of 1-olefins to provide polymers such as polyalphaolefin or PAO oils, or from hydrocarbon synthesis procedures using carbon monoxide and hydrogen gases such as in a Fischer-Tropsch process. For example, a suitable base oil is one that comprises little, if any, heavy fraction; e.g., little, if any, lube oil fraction of viscosity 20 cSt or higher at 100° C.

The base oil may be derived from natural lubricating oils, synthetic lubricating oils or mixtures thereof. Suitable base oil includes base stocks obtained by isomerization of synthetic wax and slack wax, as well as hydrocracked base stocks produced by hydrocracking (rather than solvent extracting) the aromatic and polar components of the crude. Suitable base oils include those in all API categories I, II, III, IV and V as defined in API Publication 1509, 14th Edition, Addendum I, December 1998. Group IV base oils are polyalphaolefins (PAO). Group V base oils include all other base oils not included in Group I, II, III, or IV.

Useful natural oils include mineral lubricating oils such as, for example, liquid petroleum oils, solvent-treated or acid-treated mineral lubricating oils of the paraffinic, naphthenic or mixed paraffinic-naphthenic types, oils derived from coal or shale, and the like.

Useful synthetic lubricating oils include, but are not limited to, hydrocarbon oils and halo-substituted hydrocarbon oils such as polymerized and interpolymerized olefins, e.g., polybutylenes, polypropylenes, propylene-isobutylene copolymers, chlorinated polybutylenes, poly(1-hexenes), poly(1-octenes), poly(1-decenes), and the like and mixtures thereof; alkylbenzenes such as dodecylbenzenes, tetradecylbenzenes, dinonylbenzenes, di(2-ethylhexyl)-benzenes, and the like; polyphenyls such as biphenyls, terphenyls, alkylated polyphenyls, and the like; alkylated diphenyl ethers and alkylated diphenyl sulfides and the derivative, analogs and homologs thereof and the like.

Other useful synthetic lubricating oils include, but are not limited to, oils made by polymerizing olefins of less than 5 carbon atoms such as ethylene, propylene, butylenes, isobutene, pentene, and mixtures thereof. Methods of preparing such polymer oils are well known to those skilled in the art.

Additional useful synthetic hydrocarbon oils include liquid polymers of alpha-olefins having the proper viscosity. Especially useful synthetic hydrocarbon oils are the hydrogenated liquid oligomers of $C_6$ to $C_{12}$ alpha-olefins such as, for example, 1-decene trimer.

Another class of useful synthetic lubricating oils include, but are not limited to, alkylene oxide polymers, i.e., homopolymers, interpolymers, and derivatives thereof where the terminal hydroxyl groups have been modified by, for example, etherification. These oils are exemplified by the oils prepared through polymerization of ethylene oxide or propylene oxide, the alkyl and phenyl ethers of these polyoxyalkylene polymers (e.g., methyl poly propylene glycol ether having an average molecular weight of 1,000, diphenyl ether of polyethylene glycol having a molecular weight of 500-1000, diethyl ether of polypropylene glycol having a molecular weight of 1,000-1,500, etc.).

Silicon-based oils such as, for example, polyalkyl-, polyaryl-, polyalkoxy- or polyaryloxy-siloxane oils and silicate oils, comprise another useful class of synthetic lubricating oils. Specific examples of these include, but are not limited to, tetraethyl silicate, tetra-isopropyl silicate, tetra-(2-ethylhexyl) silicate, tetra-(4-methyl-hexyl)silicate, tetra-(p-tert-butylphenyl)silicate, hexyl-(4-methyl-2-pentoxy)disiloxane, poly(methyl)siloxanes, poly(methylphenyl)siloxanes, and the like. Still yet other useful synthetic lubricating oils include, but are not limited to, liquid esters of phosphorous containing acids, e.g., tricresyl phosphate, trioctyl phosphate, diethyl ester of decane phosphionic acid, etc., polymeric tetrahydrofurans and the like.

The lubricating oil may be derived from unrefined, refined and rerefined oils, either natural, synthetic or mixtures of two or more of any of these of the type disclosed herein above. Unrefined oils are those obtained directly from a natural or synthetic source (e.g., coal, shale, or tar sands bitumen) without further purification or treatment. Examples of unrefined oils include, but are not limited to, a shale oil obtained directly from retorting operations or a petroleum oil obtained directly from distillation, each of which is then used without further treatment. Refined oils are similar to the unrefined oils except they have been further treated in one or more purification steps to improve one or more properties. These purification techniques are known to those of skill in the art and include, for example, solvent extractions, secondary distillation, acid or base extraction, filtration, percolation, hydrotreating, dewaxing, etc. Rerefined oils are obtained by treating used oils in processes similar to those used to obtain refined oils. Such rerefined oils are also known as reclaimed or reprocessed oils and often are additionally processed by techniques directed to removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst.

Natural waxes are typically the slack waxes recovered by the solvent dewaxing of mineral oils; synthetic waxes are typically the wax produced by the Fischer-Tropsch process.

It is preferred to use a major amount of base oil in the lubricating oil of this invention. A major amount of base oil as defined herein comprises 50 weight % or more, preferably greater than about 70 weight percent, more preferably from about 80 to about 99.5 weight percent and most preferably from about 85 to about 98 weight % of at least one of Group I, II, III and IV base oil. When weight % is used herein, it is referring to weight % of the lubricating oil unless otherwise specified.

Wear Inhibitor

Typically, the functional fluid also contains at least one wear inhibitor. The at least one wear inhibitor may be an oil soluble amount of a borated glycerol or an oil soluble amount of a glycerol carbonate.

In one embodiment, the functional fluid of the present invention contains a wear inhibitor additive that is commonly known as borated glycerol, which is typically synthesized as described below.

An amount of glycerol is heated to about 50° C. under nitrogen. An amount of boric acid is added to the glycerol and is heated to about 90° C. The mixture is held for approximately 30 minutes. The mixture is further heated to about 220° C. and held for an additional 30 minutes with nitrogen sweeping to remove water. Approximately, 3 parts glycerol is added to one part of boric acid.

In one embodiment, the functional fluid of the present invention contains the wear inhibitor additive, glycerol carbonate, which has a trade name of JEFFSOL® glycerine carbonate and may be purchased from Huntsman Chemical Corporation, The Woodlands, Tex.

In one embodiment, the functional fluid comprises greater than about 0.1 wt % glycerol carbonate. In one embodiment, the functional fluid comprises greater than about 0.1 wt % to about 2.0 wt % glycerol carbonate. More preferred, the functional fluid comprises from about 0.15 wt % to about 1.5 wt % glycerol carbonate. Most preferred, the functional fluid comprises from about 0.15 wt % to about 1.0 wt % glycerol carbonate.

In one embodiment, the functional fluid comprises greater than 0.1 wt % borated glycerol and less than or equal to about 0.5 wt % borated glycerol. In one embodiment, the functional fluid comprises from greater than 0.1 wt % borated glycerol to about 0.4 wt % borated glycerol. More preferred, the functional fluid comprises from greater than 0.1 wt % borated glycerol to about 0.3 wt % borated glycerol.

In one embodiment, the functional fluid comprises (i) more than about 0.1 wt % glycerol carbonate or (ii) greater than 0.1 wt % borated glycerol and less than or equal to about 0.5 wt % borated glycerol.

In one embodiment the functional fluid of the present invention may also comprise at least one low overbased detergent, at least one high overbased detergent and at least one antiwear additive.

Overbased Detergent Additives

Overbased detergent additives are well known in the art and preferably are alkali or alkaline earth metal overbased detergent additives. Such detergent additives are prepared by reacting a metal oxide or metal hydroxide with a substrate and carbon dioxide gas. The substrate is typically an acid, usually an acid selected from the group consisting of aliphatic substituted sulfonic acids, aliphatic substituted carboxylic acids, and aliphatic substituted phenols.

The terminology "overbased" relates to metal salts, preferably, metal salts of sulfonates, carboxylates and phenates, wherein the amount of metal present exceeds the stoichiometric amount. Such salts are said to have conversion levels in excess of 100% (i.e., they comprise more than 100% of the theoretical amount of metal needed to convert the acid to its "normal", "neutral" salt). The expression "metal ratio", often abbreviated as MR, is used in the prior art and herein to designate the ratio of total chemical equivalents of metal in the overbased salt to chemical equivalents of the metal in a neutral salt according to known chemical reactivity and stoichiometry. Thus, in a normal or neutral salt, the metal ratio is one and in an overbased salt, MR, is greater than one. They are commonly referred to as overbased, hyperbased or superbased salts and are usually salts of organic sulfur acids, carboxylic acids, or phenols.

The overbased detergent typically has a metal to substrate ratio of at least 1.1:1, preferably at least 2:1, more preferably at least 4:1, or at least 10:1.

Sulfonic acids include the mono or polynuclear aromatic or cycloaliphatic compounds which, when overbased, are called sulfonates.

Specific examples of sulfonic acids useful in this invention are mahogany sulfonic acids; bright stock sulfonic acids; sulfonic acids derived from lubricating oil fractions having a Saybolt viscosity from about 100 seconds at 100° F. to about 200 seconds at 210° F.; petrolatum sulfonic acids; mono and polywax substituted sulfonic and polysulfonic acids of, e.g., benzene, naphthalene, phenol, diphenyl ether, naphthalene disulfide, diphenylamine, thiophene, alphachloronaphthalene, etc.; other substituted sulfonic acids such as alkyl benzene sulfonic acids (where the alkyl group has at least 8 carbons), cetylphenol monosulfide sulfonic acids, dicetyl thianthrene disulfonic acids, dilauryl beta naphthyl sulfonic acid, dicapryl nitronaphthalene sulfonic acids, and alkaryl sulfonic acids such as dodecyl benzene "bottoms" sulfonic acids.

The bottoms acids are derived from benzene that has been alkylated with propylene tetramers or isobutene trimers to introduce 1, 2, 3 or more branched chain $C_{12}$ substituents on the benzene ring. Dodecyl benzene bottoms, principally mixtures of mono and didodecyl benzenes, are available as by-products from the manufacture of household detergents. Similar products obtained from alkylation bottoms formed during manufacture of linear alkyl sulfonates (LAS) are also useful in making the sulfonates used in this invention.

The production of sulfonates from detergent manufacture products by reaction with, e.g., $SO_3$, is well known to those skilled in the art. See, for example, the articles "Sulfonation and Sulfation", Vol. 23, pp. 146 et seq. and "Sulfonic Acids", Vol. 23, pp. 194 et seq, both in Kirk Othmer "Encyclopedia of Chemical Technology", Fourth Edition, published by John Wiley & Sons, N.Y. (1997).

Also included are aliphatic sulfonic acids containing at least about 7 carbon atoms, often at least about 12 carbon atoms in the aliphatic group, such as paraffin wax sulfonic acids, unsaturated paraffin wax sulfonic acids, hydroxy substituted paraffin wax sulfonic acids, hexapropylene sulfonic acids, tetraamylene sulfonic acids, polyisobutene sulfonic acids wherein the polyisobutene contains from 20 to 7000 or more carbon atoms, chloro substituted paraffin wax sulfonic acids, nitroparaffiin wax sulfonic acids, etc.; cycloaliphatic sulfonic acids such as petroleum naphthene sulfonic acids, cetyl cyclopentyl sulfonic acids, lauryl cyclohexyl sulfonic acids, bis(isobutyl)cyclohexyl sulfonic acids, etc.

With respect to the sulfonic acids or salts thereof described herein, it is intended that the term "petroleum sulfonic acids" or "petroleum sulfonates" includes all sulfonic acids or the salts thereof derived from petroleum products. A particularly valuable group of petroleum sulfonic acids are the mahogany sulfonic acids (so called because of their reddish brown color) obtained as a by-product from the manufacture of petroleum white oils by a sulfonic acid process.

Other descriptions of overbased sulfonate salts and techniques for making them can be found in the following U.S. Pat. Nos. 2,174,110; 2,174,506; 2,174,508; 2,193,824; 2,197,800; 2,202,781; 2,212,786; 2,213,360; 2,228,598; 2,223,676; 2,239,974; 2,263,312; 2,276,090; 2,276,297; 2,315,514; 2,319,121; 2,321,022; 2,333,568; 2,333,788; 2,335,259; 2,337,552; 2,346,568; 2,366,027; 2,374,193; 2,383,319; 3,312,618; 3,471,403; 3,488,284; 3,595,790; and 3,798,012. Each of these patents is hereby incorporated by reference in its entirety.

In one embodiment, a low overbased detergent is employed. Preferably, the low overbased detergent is a low overbased sulfonate detergent. More preferred, the low overbased sulfonate detergent is a low overbased alkaline earth metal sulfonate detergent. Most preferred, the alkaline earth metal is selected from calcium, magnesium, sodium, strontium or barium. Even more preferred, the low overbased alkaline earth metal sulfonate detergent is a low overbased calcium sulfonate detergent.

In one embodiment, a medium overbased detergent is employed. Preferably, the medium overbased detergent is medium overbased calcium sulfonate.

Preferably, the high overbased detergent is a high overbased sulfonate detergent. More preferred, the high overbased sulfonate detergent is a high overbased alkaline earth metal sulfonate detergent. Most preferred, the alkaline earth metal is selected from calcium, magnesium, sodium or barium. Even more preferred, the high overbased alkaline earth metal sulfonate detergent is a high overbased calcium sulfonate detergent or a high overbased magnesium detergent.

In one embodiment, non-sulfonate containing detergents are employed. Such detergents include, but are not limited to, carboxylate and phenate detergents. These carboxylate detergents or phenate detergents or both may be in the functional fluid containing the glycerol additive.

Typical carboxylate detergents employed are those that are described in U.S. Pat. Nos. 7,163,911; 7,465,696 and the like which are herein incorporated by reference.

Typical phenate detergents employed are those that are described in U.S. Pat. No. 7,435,709 and the like, which are herein incorporated by reference.

Antiwear Additive

Antiwear additives may be employed in the functional fluid of the present invention. Examples of antiwear additives that may be employed in the present invention include zinc dialky-1-dithiophosphate (primary alkyl, secondary alkyl, and aryl type), diphenyl sulfide, methyl trichlorostearate, chlorinated naphthalene, fluoroalkylpolysiloxane, lead naphthenate, neutralized phosphates, dithiophosphates, and sulfur-free phosphates. Preferably, the antiwear additive is zinc dialkyl thiophospate. More preferred, the zinc dialkyl dithiophosphate is derived from a primary alcohol.

Besides borated glycerol, glycerol carbonate, detergents and antiwear additives employed in the functional fluid of the present invention, the functional fluid may also comprise other additives described below. These additional components can be blended in any order and can be blended as combinations of components.

Other Additive Components

The following additive components are examples of some of the components that can be favorably employed in the present invention. These examples of additives are provided to illustrate the present invention, but they are not intended to limit it:

A. Metal Detergents

Sulfurized or unsulfurized alkyl or alkenyl phenates, sulfonates derived from synthetic or natural feedstocks, carboxylates, salicylates, phenalates, sulfurized or unsulfurized metal salts of multi-hydroxy alkyl or alkenyl aromatic compounds, alkyl or alkenyl hydroxy aromatic sulfonates, sulfurized or unsulfurized alkyl or alkenyl naphthenates, metal salts of alkanoic, acids, metal salts of an alkyl or alkenyl multiacid, and chemical and physical mixtures thereof.

B. Anti-Oxidants

Anti-oxidants reduce the tendency of mineral oils to deteriorate in service which deterioration is evidenced by the products of oxidation such as sludge and varnish-like deposits on the metal surfaces and by an increase in viscosity. Anti-oxidants may include, but are not limited to, such anti-oxidants as phenol type (phenolic) oxidation inhibitors, such as 4,4'-methylene-bis(2,6-di-tert-butylphenol), 4,4'-bis(2,6-di-tert-butylphenol), 4,4'-bis(2-methyl-6-tert-butylphenol), 2,2'-methylene-bis(4-methyl-6-tert-butylphenol), 4,4'-butyldene-bis(3-methyl-6-tert-butylphenol), 4,4'-isopropylidene-bis(2,6-di-tert-bulylphenol), 2,2'-methylene-bis(4-methyl-6-nonylphenol), 2,2'-isobutylidene-bis(4,6-dimethylphenol), 2,2'-methylene-bis(4-methyl-6-cyclohexylphenol), 2,6-di-tert-butyl-1-4-methylphenol, 2,6-di-tert-butyl-4-ethylphenol, 2,4-dimethyl-6-tert-butylphenol, 2,6-di-tert-dimethylamino-p-cresol, 2,6-di-tert-4-(N,N'-dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-butylbenzyl)-sulfide, and bis(3,5-di-tert-butyl-4-hydroxybenzyl). Diphenylamine-type oxidation inhibitors include, but are not limited to, alkylated diphenylamine, phenyl-.alpha.-naphthylamine, and alkylated-.alpha.-naphthylamine. Other types of oxidation inhibitors include metal dithiocarbamate (e.g., zinc dithiocarbamate), and methylenebis(dibutyidithiocarbamate). The anti-oxidant is generally incorporated into an oil in an amount of about 0 to about 10 wt %, preferably 0.05 to about 3.0 wt %, per total amount of the engine oil.

C. Anti-Wear/Extreme Pressure Agents

As their name implies, these agents reduce wear of moving metallic parts. Examples of such agents include, but are not limited to, phosphates, phosphites, carbamates, esters, sulfur containing compounds, molybdenum complexes, zinc dialkyldithiophosphate (primary alkyl, secondary alkyl, and aryl type), sulfurized oils, sulfurized isobutylene, sulfurized polybutene, diphenyl sulfide, methyl trichlorostearate, chlorinated naphthalene, fluoroalkylpolysiloxane, and lead naphthenate.

D. Rust Inhibitors (Anti-Rust Agents)

1) Nonionic polyoxyethylene surface active agents: polyoxyethylene lauryl ether, polyoxyethylene higher alcohol ether, polyoxyethylene nonyl phenyl ether, polyoxyethylene octyl phenyl ether, polyoxyethylene octyl stearyl ether, polyoxyethylene oleyl ether, polyoxyethylene sorbitol monostearate, polyoxyethylene sorbitol monooleate, and polyethylene glycol monooleate.
2) Other compounds: stearic acid and other fatty acids, dicarboxylic acids, metal soaps, fatty acid amine salts, metal salts of heavy sulfonic acid, partial carboxylic acid ester of polyhydric alcohol, and phosphoric ester.

E. Demulsifiers

Addition product of alkylphenol and ethylene oxide, polyoxyethylene alkyl ether, and polyoxyethylene sorbitan ester.

F. Friction Modifiers

Fatty alcohols, 1,2-diols, borated 1,2-diols, fatty acids, amines, fatty acid amides, borated esters, and other esters.

G. Multifunctional Additives

Sulfurized oxymolybdenum dithiocarbamate, sulfurized oxymolybdenum organo phosphorodithioate, oxymolybdenum monoglyceride, oxymolybdenum diethylate amide, amine-molybdenum complex compound, and sulfur-containing molybdenum complex compound.

H. Viscosity Index Improvers

Polymethacrylate type polymers, ethylene-propylene copolymers, styrene-isoprene copolymers, hydrogenated styrene-isoprene copolymers, polyisobutylene, and dispersant type viscosity index improvers.

I. Pour Point Depressants

Polymethyl methacrylate.

J. Foam Inhibitors

Alkyl methacrylate polymers and dimethyl silicone polymers.

K. Metal Deactivators

Disalicylidene propylenediamine, triazole derivatives, mercaptobenzothiazoles, thiadiazole derivatives, and mercaptobenzimidazoles.

L. Dispersants

Alkenyl succinimides, alkenyl succinimides modified with other organic compounds, alkenyl succinimides modified by post-treatment with ethylene carbonate or boric acid, esters of polyalcohols and polyisobutenyl succinic anhydride, phenate-salicylates and their post-treated analogs, alkali metal or mixed alkali metal, alkaline earth metal borates, dispersions of hydrated alkali metal borates, dispersions of alkaline-earth metal borates, polyamide ashless dispersants and the like or mixtures of such dispersants.

Additive Packages

In another embodiment, the invention is directed to additive concentrates for functional fluids that contain an oil soluble amount of borated glycerol or an oil soluble amount of glycerol carbonate. The borated glycerol containing additive concentrate or glycerol carbonate containing additive concentrate may be provided as an additive package or concentrate which will be incorporated into a substantially inert, normally liquid organic diluent such as, for example, mineral oil, naphtha, benzene, toluene or xylene to form an additive concentrate. These concentrates usually contain from about 1% to about 99% by weight, and in one embodiment about 10% to about 90% by weight of such diluent. Typically, a neutral oil having a viscosity of about 4 to about 8.5 cSt at 100° C. and preferably about 4 to about 6 cSt at 100° C. will be used as the diluent, though synthetic oils, as well as other organic liquids which are compatible with the additives and finished lubricating oil can also be used.

In one embodiment, the invention is directed a method of reducing friction comprising contacting a metal surface with a functional fluid comprising a major amount of an oil of lubricating viscosity and an oil soluble amount of (i) glycerol carbonate or an oil soluble amount of (ii) borated glycerol.

EXAMPLES

The invention will be further illustrated by the following examples, which set forth particularly advantageous method embodiments. While the Examples are provided to illustrate the present invention, they are not intended to limit it. This application is intended to cover those various changes and substitutions that may be made by those skilled in the art without departing from the spirit and scope of the appended claims.

Example A

A baseline formulation was prepared which contained:

(i) 1.85 wt % of a 27 TBN oil concentrate of a Ca sulfonate detergent;
(ii) 1.89 wt % of a 320 TBN oil concentrate of a Ca sulfonate detergent;

(iii) 1.53 wt-% of an oil concentrate of a zinc dithiophosphate derived from a primary alcohol containing 7.3 wt % phosphorous; and (iv) the balance, a Group II base oil.

Example 1

A lubricating oil composition was prepared by top-treating the baseline formulation of Example A with 0.15 wt. % of glycerol carbonate.

Example 2

A lubricating oil composition was prepared by top-treating the baseline formulation of Example A with 1.00 wt. % of glycerol carbonate.

Example 3

A lubricating oil composition was prepared by top-treating the baseline formulation of Example A with 0.15 wt. % of borated glycerol. Borated glycerol was prepared as by adding glycerol (100 g, 2 eq.) to a round bottom flask. The flask was heated to 50° C. under nitrogen. Boric acid (33.6 g, 1 eq.) was then added portion wise to the heated flask. The mixture was heated to 90° C. and held for 30 minutes. The mixture was further heated to 220° C. and held for an additional 30 minutes with nitrogen sweeping to remove water. Approximately 104 grams of gel was recovered. Boron content=6.87%

Example B

A lubricating oil composition was prepared by top-treating the baseline formulation of Example A with 0.1 wt. % of glycerol carbonate.

Example C

A lubricating oil composition was prepared by top-treating the baseline formulation of Example A with 0.1 wt. % of borated glycerol.

Evaluation of Slow Speed Gear Performance

Slow speed gear performance is evaluated using ZF Group's ZF V3 test, which is also known as the S19-5 test. In this test, an FZG stand is operated for 120 hours under controlled conditions of speed (9 rpm input speed, 13 rpm pinion speed), load (tenth stage) and temperature (90° C. for 40 hours, 120° C. for 40 hours and 90° C. for 40 hours). The test gears are lubricated with the test oil. The gear and pinion are weighed before and after the test. The gear weight loss and pinion weight loss are used to evaluate the wear obtained with the test fluid. In order to pass the test, the total weight loss (gear weight loss+pinion weight loss) must be less than 30 mg.

Slow speed gear performance results are presented in Table 1. Test results from lubricating oil compositions containing a variety of different glycerol-type friction modifiers are included. If the test resulted in a total weight loss of more than 30 mg at 80 hours, the test was discontinued at that point.

TABLE 1

S19-5 Slow Speed Gear Performance Results

| | Friction Modifier | Amount In Finished Oil (wt. %) | Total Weight Loss at 80 hr (mg) | Total Weight Loss at 120 hr (mg) | Pass/ Fail |
|---|---|---|---|---|---|
| Ex. 1 | Glycerol Carbonate | 0.15 | — | 12 | Pass |
| Ex. 2 | Glycerol Carbonate | 1.00 | — | 8 | Pass |
| Ex. 3 | Borated Glycerol | 0.5 | — | 5 | Pass |
| Ex. A | None | — | — | 789 | Fail |
| Ex. B | Glycerol Carbonate | 0.1 | — | 772 | Fail |
| Ex. C | Borated Glycerol | 0.1 | — | 888 | Fail |

As evidenced by the Total Weight Loss at 120 hr, glycerol carbonate and borated glycerol yield a total weight loss of less than 30 mg at 120 hr, thereby exhibiting that they provide good wear inhibiting qualities.

What is claimed is:

1. A tractor hydraulic fluid comprising (a) a major amount of an oil of lubricating viscosity, (b) an oil soluble amount of glycerol carbonate, and (c) at least one detergent selected from at least one low overbased sulfonate, at least one medium overbased sulfonate, at least one high overbased sulfonate, and at least one non-sulfonate detergent;

wherein the oil soluble amount of glycerol carbonate is greater than about 0.15 wt % to about 2.0 wt % of glycerol carbonate.

2. The tractor hydraulic fluid of claim 1 wherein the low overbased sulfonate is a low overbased calcium sulfonate.

3. The tractor hydraulic fluid of claim 1 wherein the non-sulfonate detergent is at least one phenate detergent or at least one carboxylate detergent.

4. The tractor hydraulic fluid of claim 1 wherein the high overbased sulfonate is a high overbased calcium sulfonate.

5. The tractor hydraulic fluid of claim 1 wherein the tractor hydraulic fluid also contains at least one additional antiwear additive.

6. The tractor hydraulic fluid of claim 5 wherein the at least one antiwear additive is zinc dialkyl dithiophosphate.

7. The tractor hydraulic fluid of claim 6 wherein the zinc dialkyl dithiophosphate is derived from a primary alcohol.

8. The tractor hydraulic fluid of claim 1 wherein the tractor hydraulic fluid comprises from about 0.15 wt % to about 1.5 wt % glycerol carbonate.

9. The tractor hydraulic fluid of claim 1 wherein the tractor hydraulic fluid comprises from about 0.15 wt % to about 1.0 wt % glycerol carbonate.

10. A tractor hydraulic fluid comprising a major amount of an oil of lubricating viscosity b. more than about 0.15 wt % to about 2.0 wt % of glycerol carbonate;

c. up to 5.0 wt % of at least one low sulfonate detergent;

d. up to 5.0 wt % of at least one high overbased sulfonate detergent; and e. at least one antiwear additive.

11. A method of reducing friction comprising contacting a metal surface with a tractor hydraulic fluid comprising a. a major amount of an oil of lubricating viscosity, b. an oil soluble amount of glycerol carbonate, and c. at least one detergent selected from at least one low overbased sulfonate, at least one medium overbased sulfonate, at least one high overbased sulfonate, and at least one non-sulfonate detergent;

wherein the oil soluble amount of glycerol carbonate is greater than from about 0.15 wt % to about 2.0 wt % of glycerol carbonate.

* * * * *